US007143468B2

(12) United States Patent
Illingworth et al.

(10) Patent No.: US 7,143,468 B2
(45) Date of Patent: Dec. 5, 2006

(54) VORTEX VACUUM CLEANER NOZZLE WITH MEANS TO PREVENT PLUME FORMATION

(76) Inventors: Lewis Illingworth, 14 Laurel La., Kensington, NH (US) 03833; David Reinfeld, 414 Johnson Ave., Englewood, NJ (US) 07631

( * ) Notice: Subject to any disclaimer, the term of this patent is extended or adjusted under 35 U.S.C. 154(b) by 530 days.

(21) Appl. No.: 10/457,112

(22) Filed: Jun. 9, 2003

(65) Prior Publication Data

US 2004/0069145 A1 Apr. 15, 2004

Related U.S. Application Data

(63) Continuation-in-part of application No. 10/025,376, filed on Dec. 19, 2001, now Pat. No. 6,719,830, which is a continuation-in-part of application No. 09/835,084, filed on Apr. 13, 2001, now Pat. No. 6,687,951, which is a continuation-in-part of application No. 09/829,416, filed on Apr. 9, 2001, now Pat. No. 6,729,839, which is a continuation-in-part of application No. 09/728,602, filed on Dec. 1, 2000, now Pat. No. 6,616,094, which is a continuation-in-part of application No. 09/316,318, filed on May 21, 1999, now Pat. No. 6,595,753.

(51) Int. Cl.
*A47L 9/02* (2006.01)
*A47L 5/14* (2006.01)

(52) U.S. Cl. ..... 15/346; 15/324; 15/415.1; 15/421; 15/422

(58) Field of Classification Search ..... 15/346, 15/347, 415.1, 324, 422, 421
See application file for complete search history.

(56) References Cited

U.S. PATENT DOCUMENTS

| | | | | | |
|---|---|---|---|---|---|
| 2,769,997 | A * | 11/1956 | Sheahan | 15/324 |
| 3,238,557 | A * | 3/1966 | Foster | 15/422 |
| 4,366,594 | A * | 1/1983 | Hyams | 15/314 |
| 4,570,287 | A * | 2/1986 | Kerschner et al. | 15/346 |
| 4,884,315 | A * | 12/1989 | Ehnert | 15/346 |
| 4,953,255 | A * | 9/1990 | Jenkins | 15/422 |
| 5,884,360 | A * | 3/1999 | Palffy | 15/346 |
| 6,687,951 | B1 * | 2/2004 | Illingworth et al. | 15/346 |
| 6,689,225 | B1 * | 2/2004 | Illingworth | 15/346 |
| 6,719,830 | B1 * | 4/2004 | Illingworth et al. | 95/270 |
| 6,811,687 | B1 * | 11/2004 | Illingworth | 210/169 |
| 6,957,472 | B1 * | 10/2005 | Illingworth et al. | 15/345 |

FOREIGN PATENT DOCUMENTS

| | | | |
|---|---|---|---|
| DE | 661573 | * | 6/1938 |
| EP | 0501675 | * | 9/1992 |
| WO | WO00/19881 | * | 4/2000 |

* cited by examiner

*Primary Examiner*—Theresa T. Snider
(74) *Attorney, Agent, or Firm*—Ward & Olivo

(57) ABSTRACT

The present invention is a novel design for a recirculating vacuum cleaner nozzle that addresses the problem of pluming by venting some internal fluid to the atmosphere. The nozzle guides fluid flow around an inner shroud within a housing. The distal end of the nozzle is exposed to the atmosphere such that air passes rapidly across its face from the outside edges to the inner duct. This rapidly moving airflow picks up dust and debris and carries it to the interior of the inner duct. Dusty air within this duct is preferably cleaned with a separator. After the fluid is cleaned, it may be sent back to the nozzle to pick up more debris. Use of the nozzle of the present invention in conjunction with a separator allows sufficient air to enter the nozzle to prevent pluming and allows the same amount of air to exit via shaped vent holes while retaining dust in the system.

18 Claims, 11 Drawing Sheets

AIRFLOW

DUSTFLOW

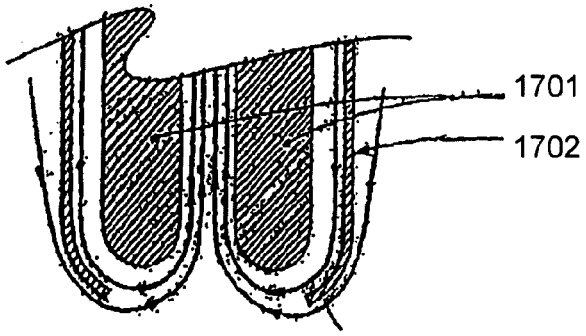
FIG. 11
FIG. 12A
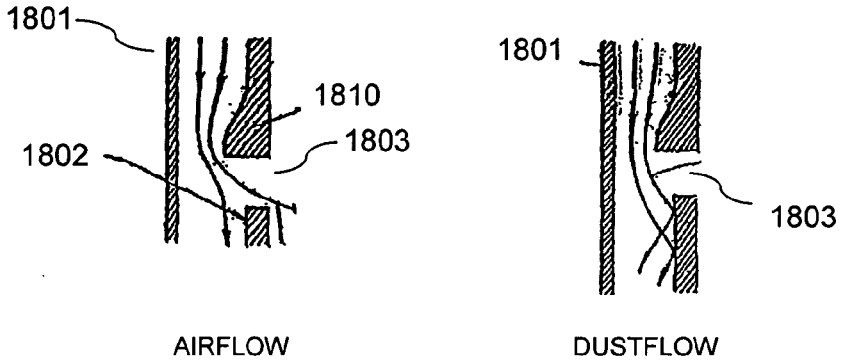
FIG. 12B
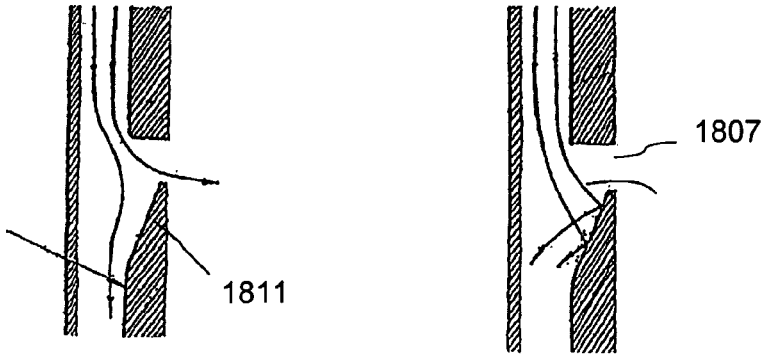

VORTEX VACUUM CLEANER NOZZLE WITH MEANS TO PREVENT PLUME FORMATION

CROSS REFERENCE TO OTHER APPLICATIONS

This application is filed as a continuation-in-part of application Ser. No. 10/025,376 entitled "Toroidal Vortex Vacuum Cleaner Centrifugal Dust Separator," filed Dec. 19, 2001, now U.S. Pat. No. 6,719,830, which is a continuation-in-part of application Ser. No. 09/835,084 entitled "Toroidal Vortex Bagless Vacuum Cleaner," filed Apr. 13, 2001, now U.S. Pat. No. 6,687,951, which is a continuation-in-part of application Ser. No. 09/829,416 entitled "Toroidal and Compound Vortex Attractor," filed Apr. 9, 2001, now U.S. Pat. No. 6.729,839, which is a continuation-in-part of application Ser. No. 09/728,602, filed Dec. 1, 2000, entitled "Lifting Platform," now U.S. Pat. No. 6,616,094, which is a continuation-in-part of Ser. No. 09/316,318, filed May 21, 1999, entitled "Vortex Attractor now U.S. Pat. No. 6,595,753."

TECHNICAL FIELD OF THE INVENTION

The present invention relates generally to an improved vacuum cleaner nozzle. More specifically, the present invention relates to an improved toroidal vortex vacuum cleaner nozzle that reduces parasitic plume formation. Thus, the present invention advances upon the ability of a toroidal vortex vacuum system to attract fine particulate matter.

BACKGROUND OF THE INVENTION

A toroidal vortex is a donut of rotating fluid. The most common example is a smoke ring. It is basically a self-sustaining natural phenomenon. FIG. 1 shows toroidal vortex 700 at an angle, sliced in two to illustrate airflow 701. In a section of the vortex, a particular air motion section is shown by stream tube 702, in which the air constantly circles around. Here stream tube 702 is shown with mean radius 703 and mean speed 704. The circular motion is maintained by a pressure differential across stream tube 702 (i.e., the pressure is higher on the outside than the inside). This pressure differential, $\Delta p$, by momentum theory, is given by the equation $\Delta p=\rho V^2/R$ where $\rho$ is air density, R is mean radius 703, and V is mean speed 704. Thus, the pressure continually decreases from the outside of toroidal vortex 700 to the center of the circular cross-section, and then increases again towards the center of toroidal vortex 700. The example shows air moving downwards on the outside of toroid 700, but the airflow direction can be reversed. In this case, the pressure profile remains the same. The downward outside motion is chosen because it is the preferred direction for use in the nozzles disclosed herein.

FIG. 2 graphically represents a typical pressure profile across a toroidal vortex. Shown is the pressure on axis 801 as a function of distance in x-direction 802. Line 803 indicates atmospheric pressure, which remains constant along x-direction 802.

The toroidal vortex nozzles disclosed herein were developed from the technology embodied in toroidal vortex attractors previously described in Applicants' application entitled "Toroidal and Compound Vortex Attractor," which is incorporated herein by reference. FIG. 3 shows a toroidal vortex attractor 900 that has motor 901 driving a centrifugal pump located Within outer housing 902. The centrifugal pump comprises blades 903 and backplate 904. This pumps air around inner shroud 905 such that the airflow forms a toroidal vortex circulating around inner shroud 905. Flow straightening vanes 906 are inserted downstream from the centrifugal pump between inner shroud 905 and outer housing 902 in order to remove the tangential component of the airflow. Thus, air travels around inner shroud 905 radially with respect to the centrifugal pump.

Air pressure within outer housing 902 is below ambient pressure. The pressure difference between ambient air and air within outer housing 902 is maintained by the curved airflow around the lower, outer edge of inner shroud 905. Here, the downward flow between inner shroud 905 and outer housing 902 is guided into a horizontal flow between inner shroud and attracted surface 907. This pressure difference is given by $\rho v^2/r$ where v is the speed of air 908 circulating around inner shroud 905, r is radius of curvature 909 of the airflow, and $\rho$ is the air density. The maximum air pressure differential, which depends upon the centrifugal pump blade tip speed V at point 910 and tip radius 911 R, is given by the equation $\rho V^2/R$.

Toroidal vortex attractor 900 can be thought of as a vacuum cleaner without a dust collection system. Dust particles are picked up from attracted surface 907 by the high speed, low pressure airflow. Because no dust collection system is provided, the dust particles circulate within toroidal vortex attractor 900.

Likewise, the toroidal vortex vacuum cleaner is a bagless design in which airflow is contained. Air continually circulates from the area being cleaned, through the dust collector, and back to the area being cleaned. Specifically, the contained airflow circulates from a vacuum cleaner nozzle, to a centrifugal separator, and back to the nozzle. A centrifugal dust separator may be used such as the one disclosed in Applicants' application Ser. No. 10/025,376, entitled "Toroidal Vortex Vacuum Cleaner Centrifugal Dust Separator," filed Dec. 19, 2001, now U.S. Pat. No. 6,719,830, which is herein incorporated by reference. Since dust is not always fully separated, some dust will remain in the airstream heading back toward the nozzle. The air already within the system, however, does not leave the system, thereby preventing dust from escaping into the atmosphere. In addition to ensuring an essentially sealed operation while the nozzle contacts a surface, the toroidal vortex vacuum cleaner's operation also remains sealed when away from a surface. Sealed operation away from a surface is important because it prevents the vacuum cleaner nozzle from blowing surface dust around and from ejecting unseparated dust into the atmosphere.

Applicants' toroidal vortex attractor is coaxial and operates such that air is blown out of an annular duct and returned into a central duct. This direction of airflow is necessary for correct operation of the toroidal vortex attractor. To demonstrate the effects of the reverse airflow, FIG. 4 is provided. System 1000 comprises outer tube 1001 and inner tube 1002 in which air passes down central delivery 1004 and returns up air return duct 1005. While it would be desirable for the outgoing air from central delivery duct 1004 to return into air return duct 1005, a simple experiment shows that this does not happen. Air from central delivery duct 1004 forms plume 1007 that continues on for a considerable distance past the opening of delivery duct 1004 before dispersing. Thus, air 1006 is sucked into the air return duct from the atmosphere. This flow design is clearly unsuited for a sealed vacuum cleaner design.

FIG. 5 shows system 1100 having the reverse airflow of FIG. 4. Again, system 1100 comprises outer tube 1101 and inner tube 1102 (which form central return duct 1105). Air is blown down outer delivery duct 1104 and returned up central return duct 1105. Air 1107 blown from outer delivery duct 1104 must be replaced by sucking air into central return duct 1105. This leads to a low-pressure zone at A. The low-pressure zone at A causes air from outer air delivery duct 1104 to bend inward. Thus, the air (whose flow is exemplified by arrows 1107) is forced to turn around on itself and enter central return duct 1105. Such action is not perfect, and some air 1108 escapes at the sides of outer delivery-duct 1104, and is replaced by the air 1106 being drawn into central return duct 1105.

FIG. 6 shows air returning from outer delivery duct 1104 into central return duct 1105 with radius of curvature 1203 ("R") and airspeed V at location 1204. With airspeed V at location 1204, the pressure difference between the ambient outer air and the inside the system is $\rho V^2/R$, where $\rho$ is the air density. The airflow at the bottom of the concentric tubes is in fact half of a toroidal vortex with the other half at the top of the inner tube 1102 within outer tube 1101. The system of FIGS. 5 and 6 is thus a vortex system with a lower than atmospheric pressure in the central return duct, and a higher than atmospheric pressure in the outer delivery duct. There is minimal mixing of internal and atmospheric air.

The simple concentric nozzle system shown in FIGS. 5 and 6 can be optimized into effective toroidal vortex vacuum cleaner nozzle 1300 depicted in FIG. 7. Inner tube 1301 is thickened and rounded off at the bottom (inner fairing 1306) to provide smooth airflow from air delivery duct 1302 to air return duct 1303. Outer tube 1304 extends below inner tube 1301 and curves inward such that air from delivery duct 1302 is redirected toward the center of toroidal vortex vacuum cleaner nozzle 1300. This minimizes the amount of air escaping from the main flow. The nozzle has flow straightening vanes 1305 to prevent the downward airflow in air delivery duct 1302 from corkscrewing. Corkscrewing may cause air to be ejected from the bottom of the outer tube 1304 due to inertia. When compared to other approaches, the vortex vacuum cleaner nozzle 1300 has less leakage and a much wider opening for the high speed air flow to pick up dust.

The vortex nozzle in its basic form is circular in cross-section, but it may take on other shapes. FIG. 8 shows rectangular nozzle 1400 terminating with inner fairings 1401 that are attached to outer tube 1402. Air is delivered via delivery duct 1403 and returns via return duct 1404. Flow straightening vanes are omitted for clarity, but are, of course, essential. Alternatively, the flat ends of rectangular nozzle 1400 may be curved such that the nozzle has a more oval-shaped cross-section.

FIG. 9 depicts the combination of a vortex nozzle and a centrifugal dirt separator, thereby yielding complete toroidal vortex vacuum cleaner 1500. Again, air ducts are created by concentrically placing inner tube 1507 within outer tube 1508. Airflow through outer air delivery duct 1502, inner air return duct 1503, and toroidal vortex nozzle 1506 (comprising flow straightening vanes 1504 and inner fairing 1505) occurs as described previously in FIGS. 6, 7, and 8. Centrifugal air pump (as in the toroidal vortex attractor of FIG. 3), comprising motor 1509, backplate 1510, and blades 1511, circulates air through the system. Air leaving blades 1511 spins rapidly such that dust and dirt are thrown out to the cylindrical sidewall of outer casing 1512. Air moves downward and inward along the bottom of dirt box 1501 such that dirt is precipitated. The air then flows upwards over dirt barrier 1513 and subsequently down the outer air delivery duct 1502. At this point, the air is clean except for fine particulates not deposited in dirt box 1501. These particulates circulate through the system repeatedly until they are captured in dirt box 1501. After use, the dirt that has been collected in dirt box 1501 can be emptied via dirt removal door 1514.

Toroidal vortex vacuum cleaner 1500 may utilize circular nozzle 1506, but the system works equally well with rectangular nozzle 1400 of FIG. 8. Various nozzle shapes can be designed and will operate satisfactorily provided that the basic cross-section of FIG. 7 is used.

Airflow across toroidal vortex nozzle 1506 from outside the system will become entrained with the internal airflow due to air friction effects to form a "plume" of air that is deleterious to the vacuum nozzle action. The effect is illustrated in FIG. 10. This shows a vortex nozzle comprising outer tube 1602 and inner donut 1601. Air flows downward between inner donut 1601 and outer tube 1602. The airflow follows the form of inner donut 1601 and turns upward through the center of inner donut 1601. Air flowing across the bottom of inner donut 1601 contacts air outside the nozzle across the opening of outer tube 1602. Friction effects between this outer air and the air moving inside the nozzle across the opening in 1602 causes outer air (shown by air streams 1603) to be drawn across the nozzle opening to the center. When air streams 1603 meet at point A, they form a high pressure stagnant point A, and air is forced to turn downward to form air plume 1604. It should be noted that air plume 1604 is formed from air outside the nozzle and there is no mixing of outside and internal air. This has been verified by computational fluid dynamics.

Plume formation is not affected by internal pressures within the nozzle. Generally speaking, the pressure in the center of the tube formed by inner donut 1601 is below atmospheric pressure whereas the pressure in the air flowing down between outer tube 1602 and inner donut 1601 is above atmospheric pressure. This air follows the curve at the bottom of inner donut 1601 regardless of internal pressures providing that the amount of air flowing up within inner donut 1601 is exactly the same as that flowing down between inner donut 1601 and outer tube 1602. Air plume 1604 is undesirable because although it contains only the concentration of dust present in the local environment, it will blow away dust underneath the nozzle.

Thus, there is a clear need for a simple vortex vacuum cleaner nozzle that addresses the problem of plume formation.

SUMMARY OF THE INVENTION

The present invention was developed from matter disclosed in Applicants' application Ser. No. 09/835,084 entitled "Toroidal Vortex Bagless Vacuum Cleaner," filed Apr. 13, 2001, now U.S. Pat. No. 6,687,951, which is incorporated herein by reference. The bagless vacuum cleaner of this invention was developed from technology disclosed in the application Ser. No. 09/829,416 entitled "Toroidal and Compound Vortex Attractor," filed Apr. 9, 2001, now U.S. Pat. No. 6,729,839, which is incorporated herein by reference. These attractors stem from technology disclosed in the application Ser. No. 09/728,602 entitled "Lifting Platform," filed on Dec. 1, 2000, now U.S. Pat. No. 6,616,094, which is incorporated herein by reference. Finally, the lifting platform technology is based upon technology disclosed in application Ser. No. 09/316,318 entitled "Vortex Attractor," filed May 21, 1999, now U.S. Pat. No. 6,595,753, which is incorporated herein by reference.

Described herein are embodiments of toroidal vortex vacuum cleaner nozzles that address the problem of plume formation. Plumes form as a result of air friction entraining outside air into the flow across the nozzle opening. While the specification refers to air as the preferred fluid, the present invention is capable of operation in most any fluid.

Pluming may be reduced or eliminated by allowing some of the air within the nozzle to escape into the atmosphere, and allowing a small amount of outside air to enter into the system. Because the nozzle is utilized in a vacuum cleaner application, it is preferable to vent air that contains as little dust as possible.

When the outer tube of the system is vented, the amount of air passing down between inner tube and outer tube is less than the amount of air flowing up the center of inner tube. This difference is compensated by air from the atmosphere drawn across and into the nozzle. Hence, the air plume can be eliminated at the price of allowing some internal air to escape.

Given are two examples of vent configurations for venting air while retaining dust. The outer tube comprises a hole, while a bulge is disposed in the inside of outer tube upstream from the hole. Because of its low mass, air flowing between outer and inner tube can change direction quickly enough to escape from the hole. Dust (or other particulate matter), because of its mass, cannot change direction quickly enough and travels downstream past hole and bounces off the bulge on inner wall of the outer tube.

Alternatively, the thickness of the outer tube can be thinned beneath a hole disposed thereon. Again, the air can escape, but the dust is forced to bounce off the thinned outer wall.

Of course, these are just two of many possible configurations. Any design that accomplishes the goal of retaining dust while allowing air to vent is contemplated. Furthermore, other means to allow some of the interior air in a toroidal vacuum nozzle, and associated system, may be implemented without departing from the principles of the invention.

Furthermore, the vents may be designed such that the vent size is controllable. This allows the vacuum cleaner to be instantly modified for different situations in which different types of matter are to be vacuumed.

Preferably, the toroidal vortex nozzle is implemented into a vacuum cleaner system. Generally, the nozzle takes in dust-laden air in through the inner tube, and dust-free air is delivered back to the annulus between the inner and outer tubes. More specifically, dust-laden air taken in through an inner tubing is sucked into impeller blades. The blades accelerate incoming air into a circular pattern inducing the cylindrical vortex flow in a separation chamber. Inside the separation chamber, dirt and debris are centrifugally separated. The cleaned air is then driven into an annulus formed by the gap between the inner and outer tubes. Straightening vanes in the annulus eliminate rotational components within the airflow. This straightened airflow is essential for a toroidal vortex nozzle to perform optimally. If air is rotating, a significant amount of air can be expelled from the annulus into the atmosphere, thus compromising the efficiency of the nozzle.

One of the main features of a vacuum cleaner system utilizing a toroidal vortex nozzle is the inherent low power consumption. The efficiency losses that exist when bags or filters are utilized are eliminated. Bags and filters resist airflow, thus requiring greater power to maintain a proper flowrate. Additional efficiency arises from the closed air system. Kinetic energy supplied by the impeller is not lost with air that is expelled into the atmosphere. Since air is not expelled, the kinetic energy of moving airflow remains within the system. Energy losses are minimized by smoothly directing airflow through the nozzle of the present invention. Hence, the disclosed system utilizes advancements in efficiency not previously considered in the art. In addition, vacuum cleaner designs utilizing nozzles of the present invention are virtually maintenance free.

It is an object of the present invention to provide toroidal vortex vacuum cleaner nozzles.

Also, it is an object of the present invention to provide toroidal vortex vacuum nozzles that do not form a plume.

Thus, it is an object of the present invention to provide an efficient vacuum cleaner nozzle.

Furthermore, it is an object of the present invention to provide a quiet vacuum cleaner nozzle.

In addition, it is an object of the present invention to provide a low-maintenance vacuum cleaner nozzle.

Also, it is an object of the present invention to facilitate an efficient, bagless vacuum cleaner.

It is yet another object of the present invention to provide a nozzle that does not blow away particulate matter in the vicinity of the nozzle.

It is a further object of the present invention to provide a straightened airflow to a vacuum cleaner nozzle.

Furthermore, it is an object of the present invention to provide a nozzle which maintains a virtually sealed operation.

It is yet another object of the invention to provide a vacuum cleaner nozzle and/or system capable of attracting small particulate matter.

These and other objects will become readily apparent to one skilled in the art upon review of the following description, figures, and claims.

BRIEF DESCRIPTION OF THE DRAWINGS

A further understanding of the present invention can be obtained by reference to a preferred embodiment set forth in the illustrations of the accompanying drawings. Although the illustrated embodiment is merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 11 depicts a cross-section of a vortex nozzle functioning with venting in accordance with the preferred embodiment of the present invention;

FIGS. 12A and 12B depict venting techniques that prevent excess dust from escaping with vented air;

DETAILED DESCRIPTION OF THE PREFERRED EMBODIMENTS

As required, a detailed illustrative embodiment of the present invention is disclosed herein. However, techniques, systems, and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. The following presents a detailed description of a preferred embodiment (as well as some alternative embodiments) of the present invention and features thereof.

Figure 1:
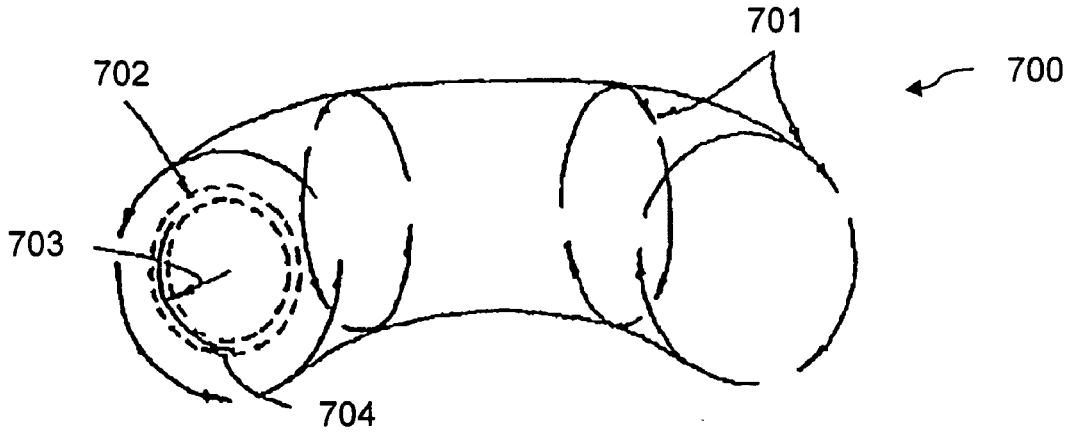
FIG. 1 (Prior Art)
FIG. 1 (PRIOR ART) is a perspective view of a partial toroidal vortex.
Figure 2:
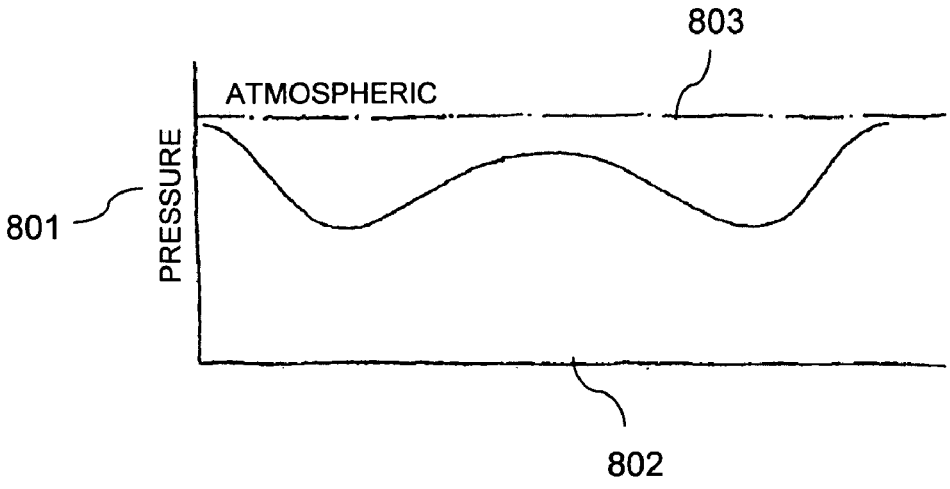
FIG. 2 (Prior Art)
FIG. 2 (PRIOR ART) graphically depicts the pressure distribution across the toroidal vortex of FIG. 7.
Figure 3:
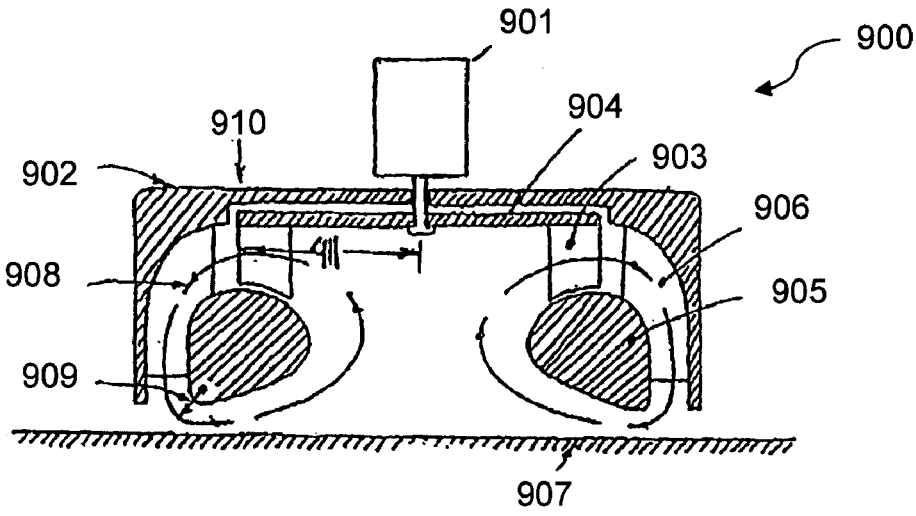
FIG. 3 (Prior Art)
FIG. 3 (PRIOR ART) depicts a cross-section of a toroidal vortex attractor.
Figure 4:
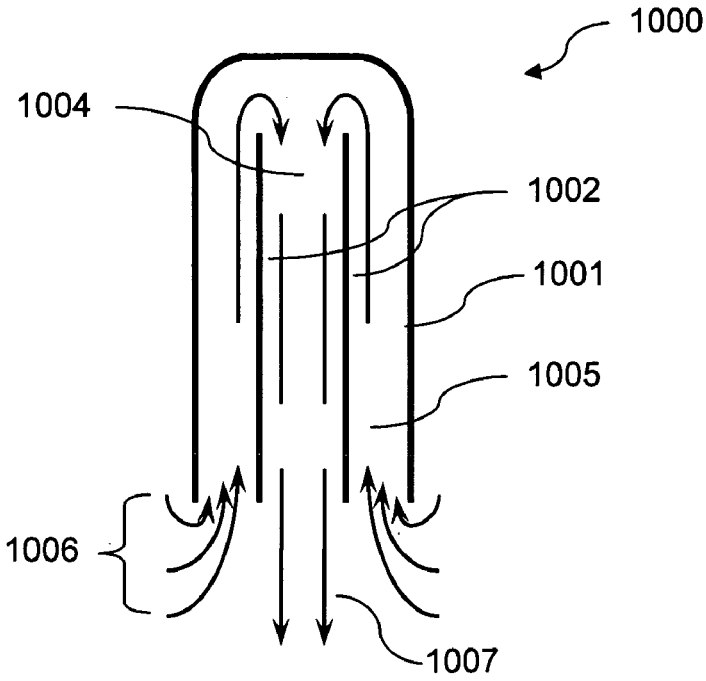
FIG. 4 (Prior Art)
FIG. 4 (PRIOR ART) depicts a cross-section of a concentric vacuum system.
Figure 5:
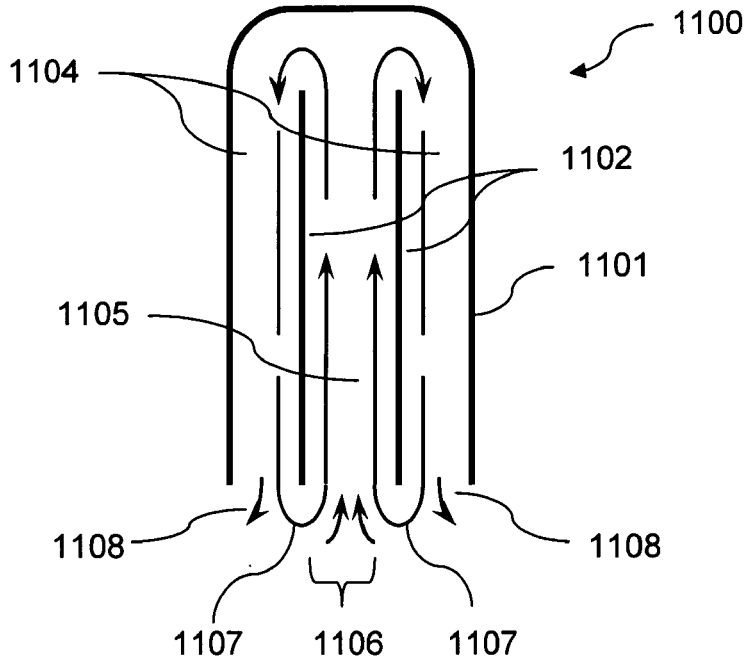
FIG. 5 (Prior Art)
FIG. 5 (PRIOR ART) depicts a cross-section of a concentric vacuum system with air being sucked into the center of the vacuum and blown down the outside of the vacuum.
Figure 6:
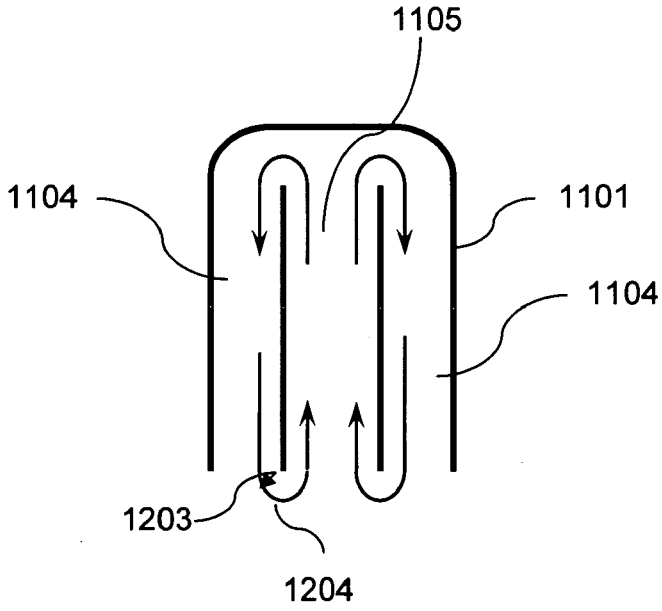
FIG. 6 (Prior Art)
FIG. 6 (PRIOR ART) depicts the dynamics of the re-entrant airflow of the system of FIG. 5.
Figure 7:
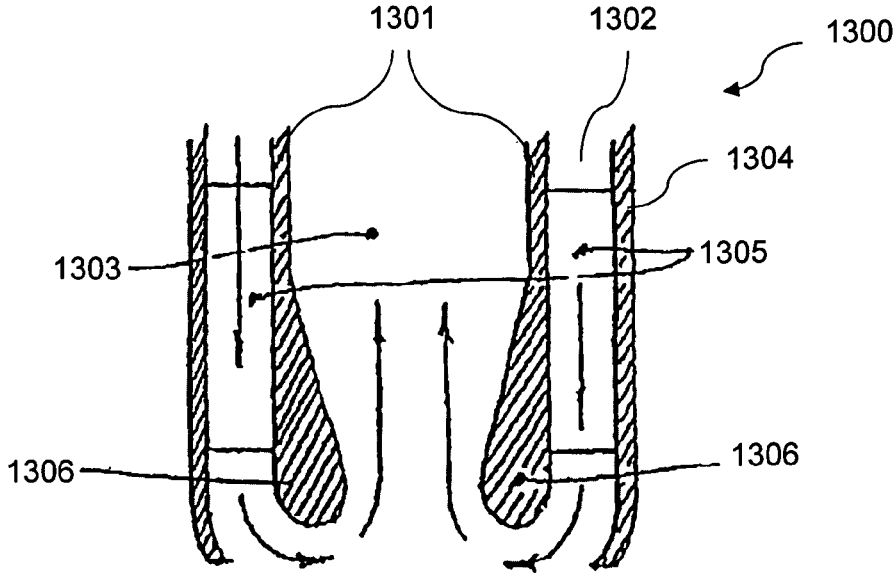
FIG. 7 (Prior Art)
FIG. 7 (PRIOR ART) depicts a cross-section of an exemplary toroidal vortex vacuum cleaner nozzle.
Figure 8:
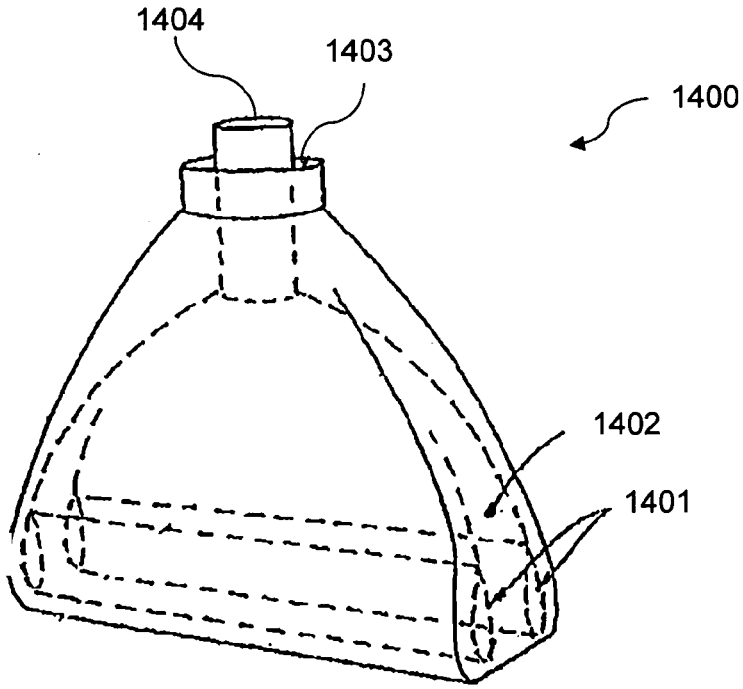
FIG. 8 (Prior Art)
FIG. 8 (PRIOR ART) depicts a perspective view of an exemplary rectangular toroidal vortex vacuum cleaner nozzle.
Figure 9:
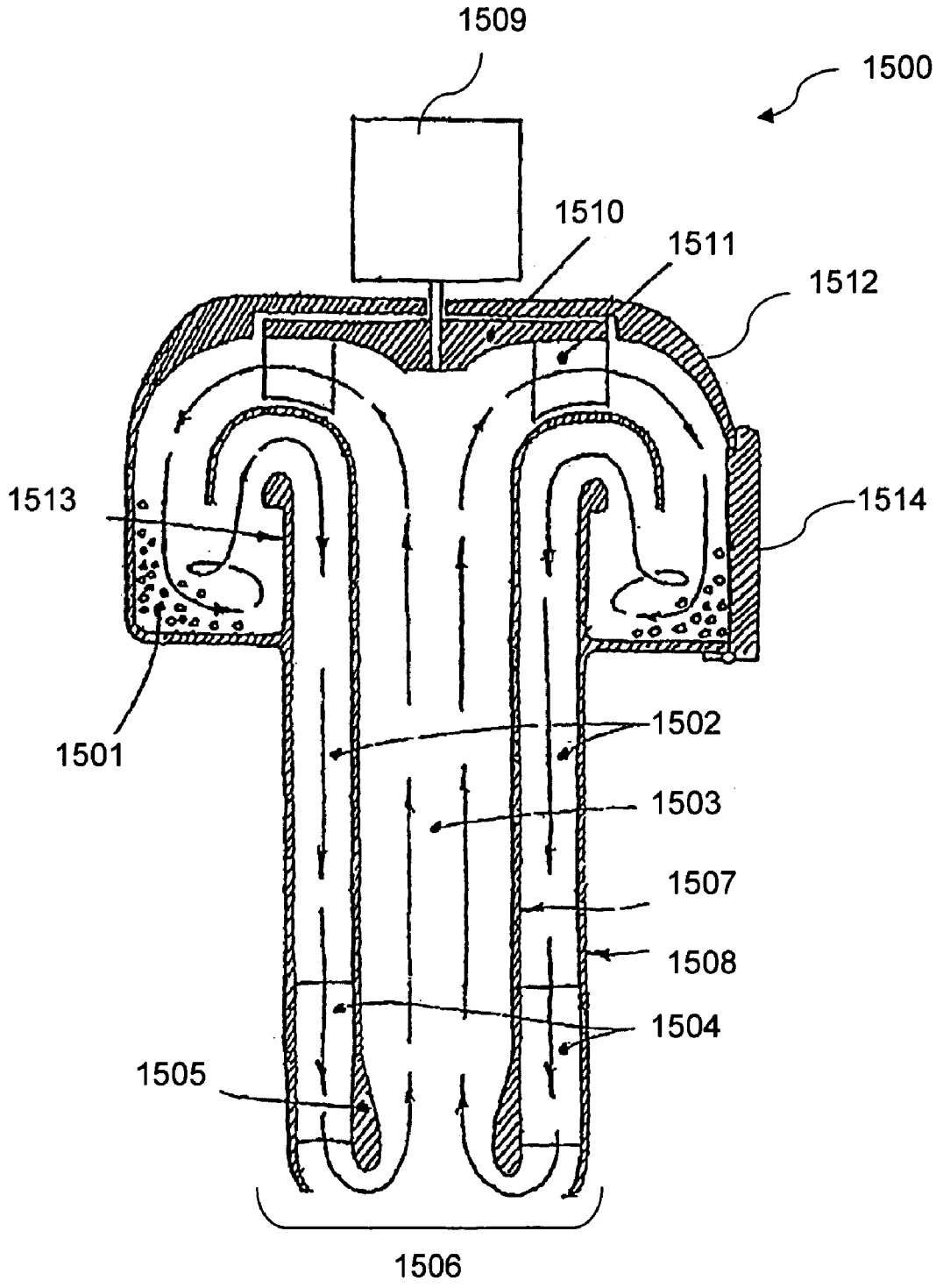
FIG. 9 (Prior Art)
FIG. 9 (PRIOR ART) depicts a cross-section of a toroidal vortex bagless vacuum cleaner having an exemplary circular plan form.
Figure 10:
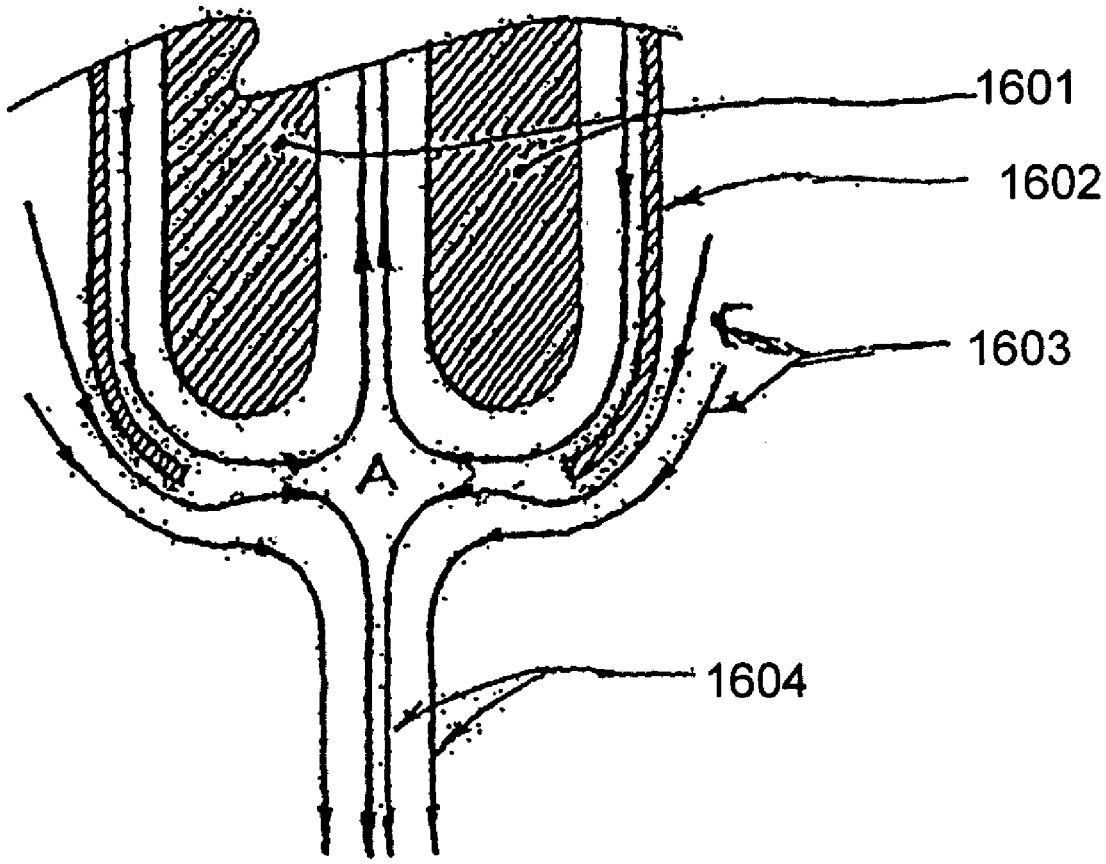
FIG. 10 (Prior Art)
FIG. 10 (PRIOR ART) depicts a cross-section of a toroidal vortex nozzle that creates a downward air plume.

As discussed above, air from the atmosphere below a toroidal vortex nozzle will become entrained with the internal airflow due to air friction effects to form a "plume" of air that is deleterious to the vacuum nozzle action. Pluming may be reduced or eliminated by allowing some of the air within the nozzle, or associated system, to escape into the atmosphere. FIG. 11 shows the resulting airflow around a nozzle in a system where some internal air is vented to the outer environment. Note that the inner donut 1701 is any type of rounded form that guides the airflow into a vortex flow in accordance with the present invention. In such a system the amount of air passing down between said inner donut 1701 and outer tube 1702 is less than the amount of air flowing up the center of inner donut 1701. This air shortfall is compensated by outer air 1703 drawn across the nozzle. In this case, the pressure corresponding to point A in FIG. 10 is below atmospheric and the outer air is drawn up into the center of inner tube 1701. Thus, air plume 1604 of FIG. 10 can be eliminated at the price of allowing some internal air to escape.

FIGS. 12A and 12B depict two possible vent configurations for venting air while retaining dust. In FIG. 12A, the right side of inner donut 1801 and outer tube 1802 is shown. Outer tube 1802 comprises hole 1803. Bulge 1810 is in the inside outer tube 1802 upstream from hole 1803. Air flowing down between outer tube 1801 and inner donut 1802 can change direction quickly enough, when the internal air pressure is greater than the atmospheric pressure, for some air to escape from hole 1803. Dust, on the other hand, cannot change course rapidly enough and travels downstream past hole 1803 and bounces harmlessly off the inner wall of outer tube 1802.

In an alternate system shown in FIG. 12B, the thickness of the outer tube 1806 wall is thinned beneath hole 1807. Once again some air escapes into the atmosphere whereas dust particles are carried by their inertia to bounce off thinned wall 1811.

Although these are two possible configurations of vents to allow some of the air to escape from inside the nozzle, and associated systems, other vent designs are possible to accomplish the same objective. Furthermore, other means to allow some of the interior air in a toroidal vacuum nozzle, and associated system, may be implemented without departing from the principles of the invention.

Importantly, these vents permit small amounts of airflow to escape, therefore minimally compromising the efficiency of the vacuum cleaner system. Furthermore, the usage of these vents is not necessary in all situations. However, venting adapts the vacuum cleaner system to perform optimally in situations involving very fine dust particles. Additionally, the vents may be designed such that the vent size is controllable. This allows the vacuum to be instantly modified for different situations in which different types of matter are to be vacuumed.

Figure 13A:
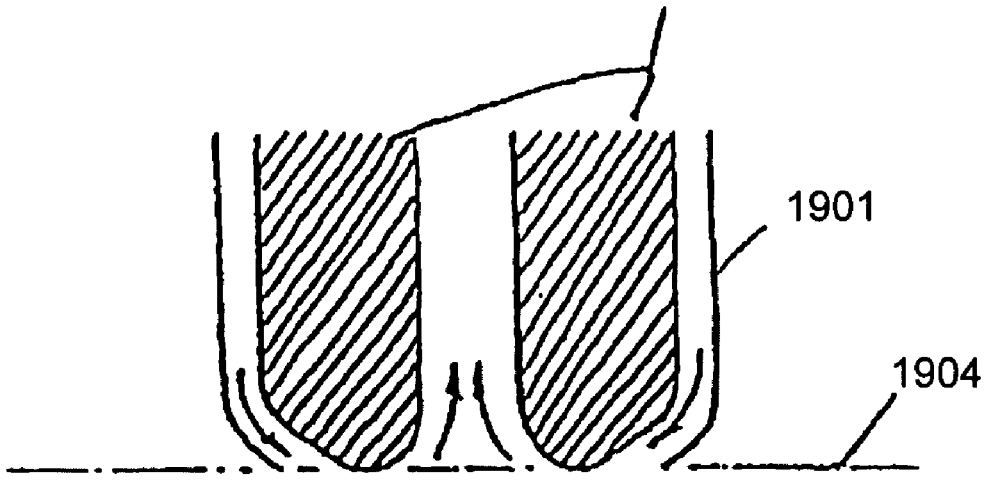
FIG. 13A depicts a widened nozzle for greater cleaning area but a more pronounced plume.

The description thus far has described toroidal vortex nozzles in which all of the air passing through the system travels around the nozzle opening without escaping into or mixing with the outer air. Where problems have arisen due to outer air being drawn across the nozzle to form a plume, they have been dealt with by allowing some of the air within the system to escape. There are occasions, however, when the nozzle opening can be widened past the point where airflow can be maintained within the system unless the flow geometry is maintained by an outside surface. FIG. 13A shows a toroidal vortex nozzle in which outer tube 1901 (which wraps around the bottom of the nozzle) is cut off to be level with the bottom of the inner donut 1902. Under operating conditions with the nozzle spaced away from a surface, or operation in mid-air, the toroidal operation would fail because airflow is unable to conform to the shape of inner donut 1902 and internal and atmospheric air would mix beneath the nozzle. However, should this nozzle be placed above a surface that is just below the lower profile line 1904, the toroidal airflow would be maintained by the surface in conjunction with the nozzle shape, and there would be no air mixing. Vacuum cleaner action relies on high speed air traveling across a surface to pick up dust and dirt. Thus, by opening up the nozzle as in FIG. 13A, the area of a surface exposed to high speed air is increased and nozzle action is enhanced. Such a nozzle configuration is suited to a floor operating type of vacuum cleaner for which a controlled distance from the floor is established.

Figure 13B:
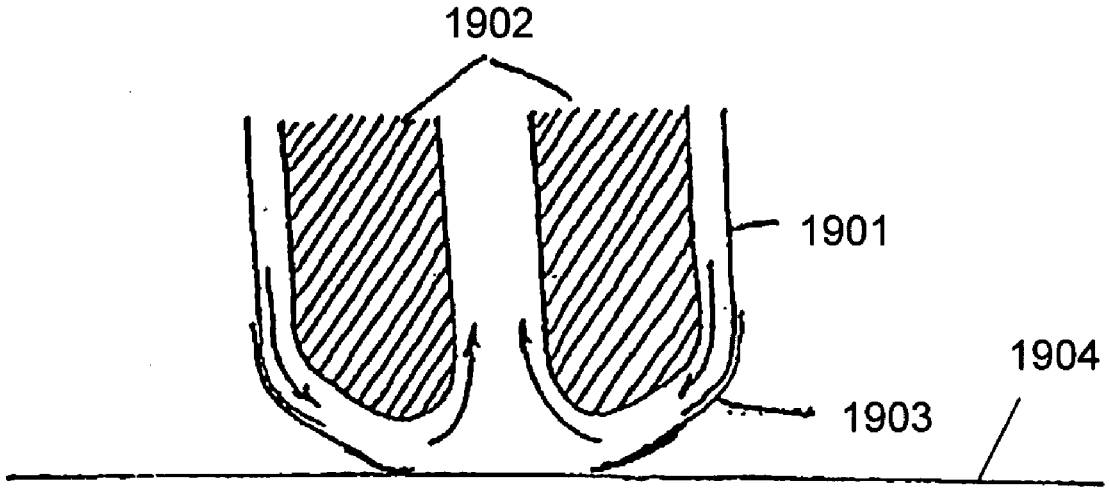
FIG. 13B depicts a sleeve fitted onto the nozzle of FIG. 13A to configure the nozzle for general purpose operation.

FIG. 13B shows how the widened nozzle of FIG. 13A can be converted to a general purpose toroidal vortex nozzle shape by the addition of clip-on sleeve 1903.

Figure 14A:
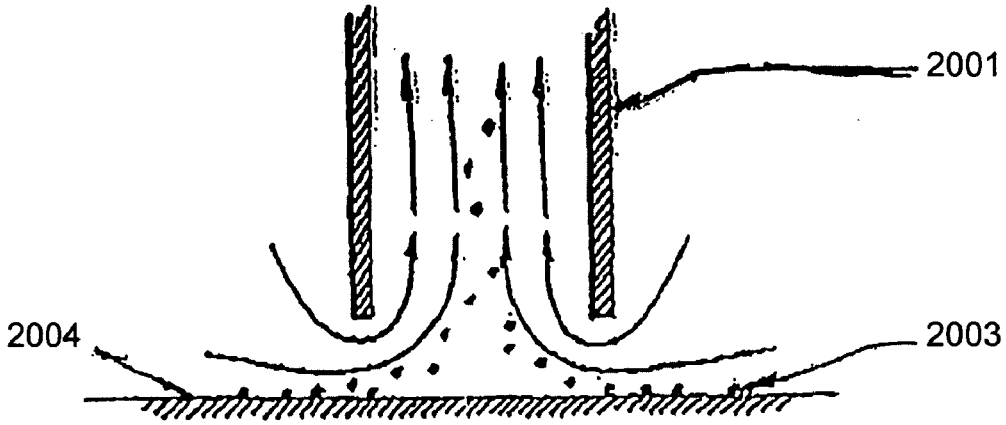
FIGS. 14A and 14B (PRIOR ART) depict conventional vacuum cleaner nozzles.
Figure 14B:
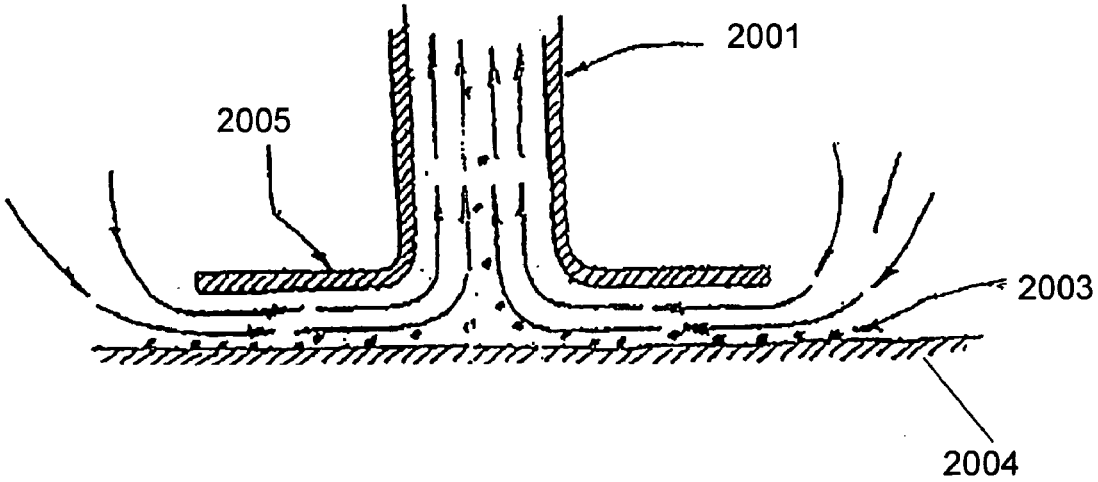

FIGS. 14A and 14B show how conventional nozzles behave in close proximity to floor 2004 or other surfaces. Air is drawn from the atmosphere and sucked into nozzle 2001 carrying dust 2003 along with it. Flanges 2005 with wheels (not shown for clarity) may be included as in FIG. 14B to fix the height of nozzle 2001. Since the effectiveness of a conventional vacuum cleaner is determined by the amount of air that can be moved, placing nozzle 2001 too close to floor 2004 compromises effectiveness by restricting airflow.

Figure 15A:
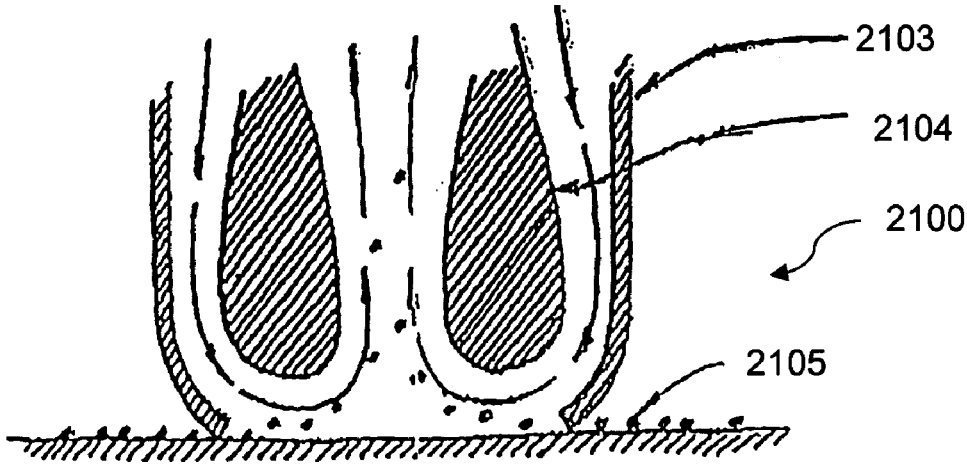
FIGS. 15A and 15B depict a toroidal vortex nozzle against a surface and a pile carpet, respectively.

The toroidal vortex nozzle avoids this problem. The airflow through nozzle 2100 is shown in FIG. 15A. Airflow is not restricted from flowing around inner donut 2104 even though the outer tube 2103 of nozzle 2100 is pressed against surface 2105. Further, the air does not need to be accelerated from a stationary state and no kinetic energy escapes the system. Moreover, air is not expelled into the atmosphere, thereby preventing the escape of unseparated dust. This also makes the use of inefficient filters unnecessary.

Figure 15B:
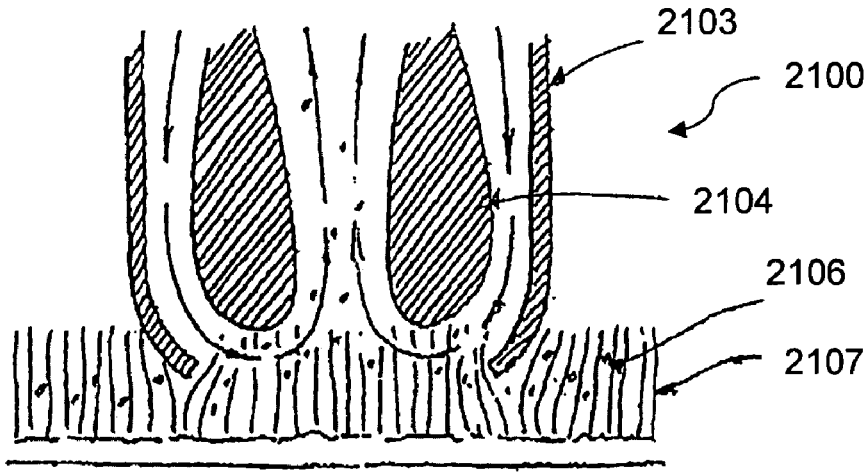

FIG. 15B shows nozzle 2100 being used on pile carpet 2107. The resultant airflow is virtually the same as described in FIG. 15A. Here, pile carpet 2107 is sucked into the nozzle such that the airflow from the annular duct between inner donut 2104 and outer tube 2103 can pass through pile carpet 2107. In this manner, dirt particles 2106 are removed from pile carpet 2107 this leads to highly effective cleaning of carpet 2107 when compared with systems that do not send air directly through carpet pile. Toroidal vortex nozzle 2100 may make the use of a brush or other means to loosen dirt particles 2106 unnecessary.

Figure 16:
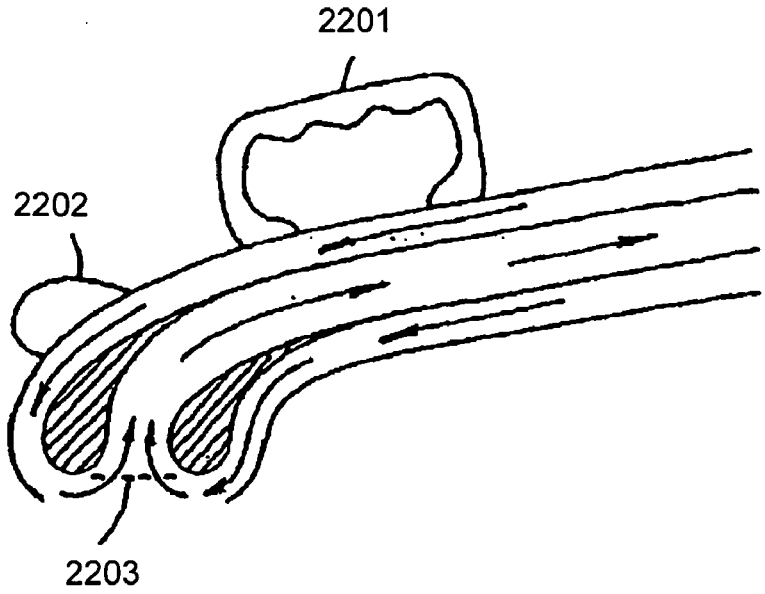
FIG. 16 depicts an alternate embodiment of a toroidal vortex nozzle comprising flow straightening vanes, a handle, a light, and a protective screen.

FIG. 16 shows an embodiment of the toroidal vortex nozzle which has handle 2201 and light 2202. The nozzle may also be angled as shown to reach difficult places. Furthermore, the nozzle opening can be fitted with protective screen 2203. Protective screen 2203 inhibits unwanted objects from entering the nozzle without interrupting toroidal vortex airflow. Protective screen 2203 may also removably constructed.

Figure 17:
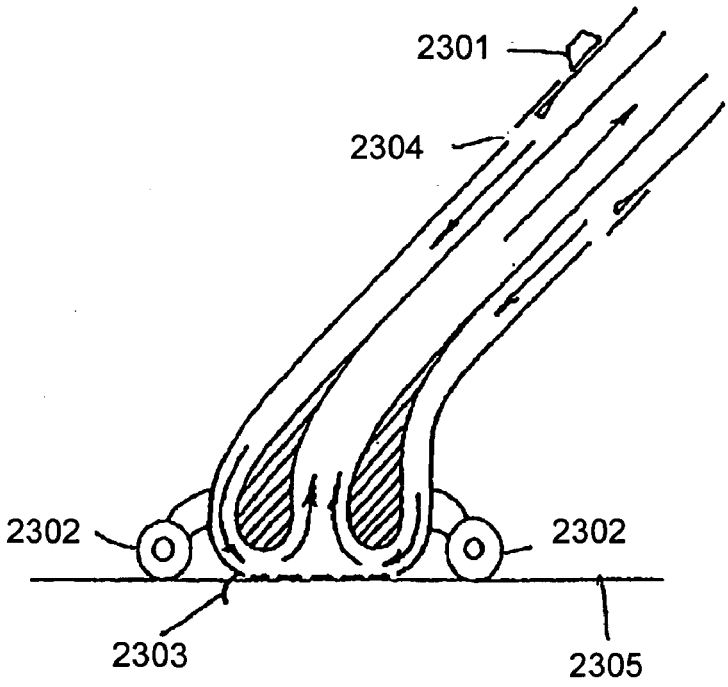
FIG. 17 depicts an alternate embodiment of a toroidal vortex nozzle comprising a ring, valve, control dial, and wheels.

Additional adjustments may be made to adopt the nozzle for specific situations. FIG. 17 exhibits some other possible nozzle design features. The nozzle may have brush bristles at nozzle end 2303 to sweep dust and dirt. A ring (such as a gasket) may also be placed at nozzle end 2303 to allow the nozzle to seal to surface 2305. One or more distancing members may also extend from the outer tube at nozzle end 2303 to distance it from surface 2305. However, air, dust, and dirt may still pass between the fingers. Nozzle end 2303 may comprise felt, or any other soft material, to prevent damage to delicate objects or surfaces. Also, wheels 2302 may be included to allow the nozzle to roll along a surface. Furthermore, vent 2304 may be controlled via dial 2301 to adjust the size of vent 2304 or open/close it completely. Other means to adjust vent 2304 are also possible. Although these are possible adaptations of the toroidal vortex nozzle, the nozzle is not limited to these adaptations. Various other embodiments may be utilized.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

We claim:

1. A toroidal vortex nozzle comprising:

an outer tube comprising at least one vent;

an inner tube disposed within said outer tube, wherein the gap between said inner tube and said outer tube forms an annular delivery duct;

at least one flow straightening vane in said annular delivery duct;

wherein fluid flows from said annular delivery duct around an inner donut to the inside of said inner tube; and wherein the wall thickness of said outer tube bulges toward said inner tube proximate to said at least one vent.

2. The vortex nozzle in accordance with claim 1, wherein the wall thickness of said outer tube is tapered proximate to said at least one vent.

3. The toroidal vortex nozzle in accordance with claim 1, wherein said nozzle has a rectangular cross-section.

4. The toroidal vortex nozzle in accordance with claim 1, wherein said nozzle has a circular cross-section.

5. The toroidal vortex nozzle in accordance with claim 1, wherein said nozzle is angled to operate at an acute angle to a surface.

6. The toroidal vortex nozzle in accordance with claim 1, wherein said nozzle further comprises a handle attached to an outer wall of said outer tube.

7. The toroidal vortex nozzle in accordance with claim 1, wherein said nozzle further comprises a light attached to an outer wall of said outer tube.

8. The toroidal vortex nozzle in accordance with claim 1, wherein said nozzle further comprises means to control the size of said vent.

9. The toroidal vortex nozzle in accordance with claim 1, further comprising a protective screen at the distal end of said nozzle.

10. The toroidal vortex nozzle in accordance with claim 9, wherein said protective screen is removable.

11. The toroidal vortex nozzle in accordance with claim 1 further comprising wheels attached to an outer wall of said outer tube.

12. The nozzle in accordance with claim 1 further comprising a sleeve coupled to said outer tube.

13. A toroidal vortex nozzle for guiding a volume of fluid flow comprising:

an inner tube;

an outer tube, said inner tube and said outer tube being concentric such that said inner tube and said outer tube form an annular duct, and further wherein said outer tube comprises at least one vent;

at least one flow straightening vane disposed within said annular duct;

a sleeve coupled to said outer tube; and wherein said fluid flows out of said annular duct around an inner donut and into said inner tube.

14. The toroidal vortex nozzle in accordance with claim 13, wherein the distal end of said nozzle has a rectangular cross-section.

15. The nozzle in accordance with claim 13, wherein the distal end of said nozzle has a circular cross-section.

16. The nozzle in accordance with claim 13, wherein said nozzle further comprises a light.

17. The nozzle in accordance with claim 13 wherein the wall thickness of said outer tube bulges toward said inner tube proximate to said at least one vent.

18. The nozzle in accordance with claim 13, wherein the wall thickness of said outer tube is tapered proximate to said at least one vent.

* * * * *